United States Patent [19]

Ray, Sr. et al.

[11] 4,232,711

[45] Nov. 11, 1980

[54] FLOW REGULATING DEVICE

[75] Inventors: Robert T. Ray, Sr.; Richard G. Pickett, both of Wilmington, Del.

[73] Assignee: Aqua-Retain Valve, Inc., Wilmington, Del.

[21] Appl. No.: 139

[22] Filed: Dec. 29, 1978

[51] Int. Cl.[3] ..... F15D 1/06

[52] U.S. Cl. ..... 138/44; 138/45; 138/46; 239/533.9; 239/452

[58] Field of Search ..... 138/44, 45, 46, 40; 239/452, 533.9, 570

[56] References Cited

U.S. PATENT DOCUMENTS

| | | | |
|---|---|---|---|
| 1,893,934 | 1/1933 | Durward | 138/45 X |
| 2,098,487 | 11/1937 | Cooper et al. | 239/570 X |
| 2,301,355 | 11/1942 | Armentrout | 138/45 |
| 2,614,888 | 10/1952 | Nichols | 239/570 X |
| 2,684,268 | 7/1954 | Hjulian | 239/570 X |
| 2,899,018 | 8/1959 | Booth | 239/570 X |
| 3,120,243 | 2/1964 | Allen et al. | 138/45 X |
| 3,165,097 | 1/1965 | Lowther | 138/45 X |
| 3,431,944 | 3/1969 | Sakuma | 138/45 |
| 3,463,132 | 8/1969 | Krieck | 138/45 X |
| 3,659,433 | 5/1972 | Shaw | 138/45 X |
| 3,877,248 | 4/1975 | Honnold | 138/44 X |
| 3,894,562 | 7/1975 | Moseley et al. | 138/44 |
| 3,999,714 | 12/1976 | Lang | 138/44 X |
| 4,000,852 | 1/1977 | Martin | 239/533.9 |
| 4,054,157 | 10/1977 | Moseley | 138/40 X |

FOREIGN PATENT DOCUMENTS

| | | | |
|---|---|---|---|
| 555112 | 1/1857 | Italy | 239/570 |

*Primary Examiner*—James E. Bryant, III

*Attorney, Agent, or Firm*—Robert W. Carlson

[57] ABSTRACT

This invention relates to a flow regulating device which may be readily installed in a water line to reduce the volume of water flowing therethrough resulting in a substantial savings in water consumption.

5 Claims, 3 Drawing Figures

FLOW REGULATING DEVICE

BACKGROUND OF THE INVENTION

During recent years it has become readily apparent that a real need exists to conserve on natural resources. Experts have awakened the consuming public that the source of natural resources such as fuel and water is not inexhaustible.

In many areas the source of water for human consumption is rain. The amount of rain varies greatly from year to year and as a result, many cities have experienced critical water shortages. In many jurisdictions, it has been necessary to ban unnecessary uses of water such as the washing of cars and the watering of lawns. These bans are relatively easy to enforce since the acts occur outside the house or apartment and are readily observed.

The consumption of water within a house or apartment is not easily policed. During water shortages, residents have been requested to voluntarily reduce water consumption. A number of devices have recently been marketed which may be placed in the water tank of toilets to reduce the amount of water consumed each time the toilet is flushed.

Some attempts have been made to provide devices which may be installed in water pipes such as in showers to reduce the amount of water flow. The normal person uses many times the amount of water necessary to take a shower with most of the water going needlessly down the drain.

Moseley Jr., et al U.S. Pat. No. 3,894,562 and Lang U.S. Pat. No. 3,999,714 show devices which are designed to reduce the volume of flow of water during a shower. The present invention is an improvement over such devices.

THE INVENTION

The present device provides a flow regulating member which can readily be installed in water lines and which will reduce water flow therethrough by approximately fifty percent.

Applicants' have tested plug devices with a straight orifice therethrough such as shown by Moseley Jr. et al and noted that the reduction in volume of flow was only approximately twenty five percent. In reducing the size of the orifice in an attempt to reduce the amount of flow, the back pressure of the water in the line was increased to the point leaks developed around the device as well as in joints of the pipeline.

Applicants' invention overcomes such problems and still achieves a fifty percent reduction in volume of fluid flow.

A preferred embodiment of the invention will now be described, by way of example, with reference to the accompanying drawings, in which.

Figure 1:
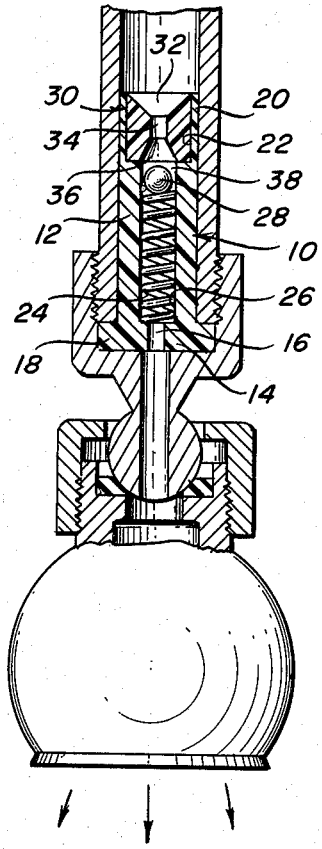
FIG. 1 is an elevational view partially in section.
Figure 2:
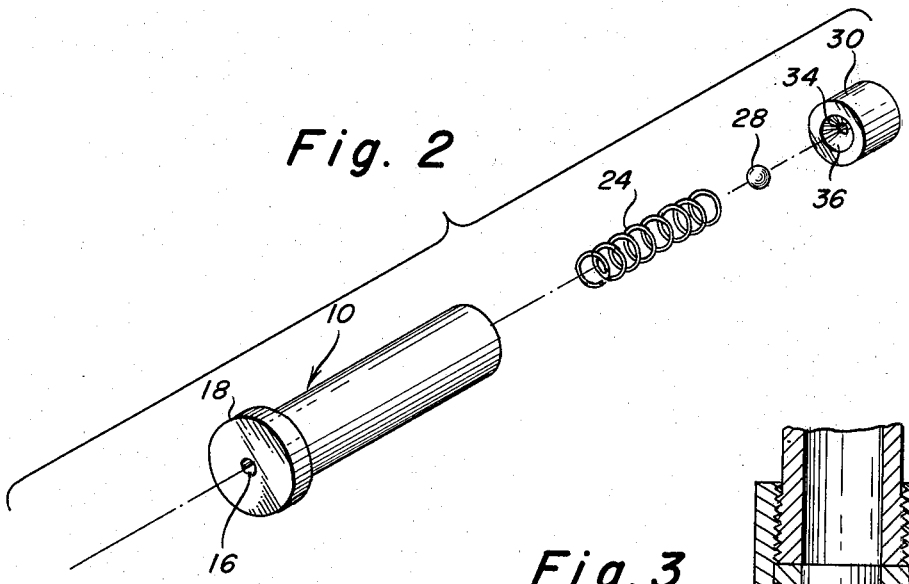
FIG. 2 is an exploded view in elevation.

The flow regulator 10 comprises a cylindrical housing 12 which may be formed of any suitable material. Plastic has been found to be preferred due to its non corrosive properties and also due to manufacturing costs. The housing 12 is closed at one end 14 with an opening 16 therethrough. A flange 18 surrounds the closed end 14, the purpose of which will become apparent later. The other end 20 of the housing 12 is provided with a first bore 22 extending longitudinally into the housing a distance substantially equal to one quarter the length of the housing. This distance is not critical and may be varied somewhat.

A second bore 24 extends longitudinally through the housing 12 from the first bore 22 and terminates adjacent the opening 16. A spring 26 is loosely held within the second bore 24 and abuts against the end 14 with a ball 28 adjacent the other end of the spring 26. Both the spring 26 and the ball 28 are made of non-corrosive material such as stainless steel. The ball 28 and spring 26 are maintained in the bore 24 by a plug 30.

The plug 30 is formed with conical depression 32 in one end thereof which terminates adjacent an orifice 34. A bore 36 extends from the other end of the plug 30 to the orifice 34. The plug 30 is inserted into the bore 22 and secured therein by a suitable adhesive.

Figure 3:
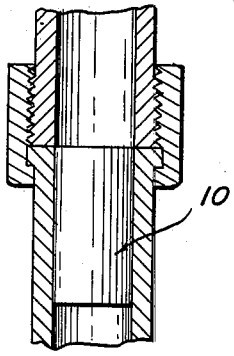
FIG. 3 is a further embodiment of the invention partially in section.

The flow regulator 10 is inserted into the water pipe as best shown in FIG. 1. In this embodiment, the flange 18 abuts the end of the water pipe and the shower head is screwed thereon in the conventional manner. In some instances, the flange 18 is omitted and the housing 12 is of constant outer diameter throughout its length; for example, if the regulator is positioned at a joint in the water pipe as illustrated in FIG. 3. The flow of water is controlled by the orifice 34, the ball 28 and spring 26.

Tests have been made on a shower line, first without the flow regulator and then with the flow regulator installed and it was determined that the flow regulator reduces the volume of flow of water by approximately 50%. The reduction of line pressure is not so great that the pattern of the shower head stream is affected to any substantial degree. The shower with the regulator installed is just as pleasing to the bather as without the regulator installed.

The angle of the conical depression 32 formed in the end is not particularly critical. It serves to reduce the amount of turbulence in the incoming stream of water. The diameter of the orifice 34 is critical to the proper functioning of the regulator. The invention has been described and illustrated for use in a conventional domestic water pipe. It may be used in any size water pipe with substantially the same reduction in water flow.

It has been determined by tests that a satisfactory ratio of the diameter of the orifice relative to the outside diameter of the body 12 is that the diameter of the orifice be equal to 0.2 of the outside diameter of the body 12. This ratio will provide satisfactory results for all sizes of water pipes.

The diameter of the bore 24 also varies as the size of the regulator is varied for different sizes of water pipes. Tests have determined that the diameter of the bore 24 be approximately twice the diameter of the orifice 34.

The length of the spring 26 is also a critical factor in the operation of the regulator. A coil spring having a diameter slightly less than the diameter of the bore 24 is satisfactory. The length of the spring should be such that the total length of the spring plus the diameter of the ball 28 is slightly less than the length of the bore 24 so that the ball 28 is spaced slightly from the orifice 34.

The strength of the spring 26 is such that it will yield slightly under water pressure so that the ball 28 will be maintained in a position spaced a small distance from the orifice 34. In this manner, the orifice 34 and the ball 28 reduce the flow of water through the line.

It was determined by tests that a regulator without a ball did not produce satisfactory results. In order to reduce the volume of flow the desired amount, the orifice had to be made quite small. As a result, substantial turbulence was created on the downstream side of the orifice. The turbulence resulted in a rumbling noise load enough to be objectionable.

With the present invention, the ball 28 serves not only to reduce the volume of flow but also serves to smooth out the flow of water downstream of the orifice 34. The spring 26 maintains the ball 28 in the turbulent area 38 so that the water is directed around the ball 28 in a smooth laminar flow pattern.

From the foregoing, it is readily apparent that the regulator may be easily and economically manufactured. The housing 12 and the plug 30 may be molded by injection molding. The spring 26 and ball 28 are commercially available. The ball 28 and spring 26 are placed in the bore 24. Adhesive is applied to the cylindrical wall of the plug 30 and the plug 30 is inserted into the bore 24. The regulator is now ready for use.

Having described the details of the invention, it will be apparent that changes and modifications will occur to those skilled in the art and all of which may fall within the spirit and scope of the appended claims wherein;

What is claimed is:

1. A flow regulator comprised of a cylindrical housing adapted to be inserted into a water line, said housing being closed at one end thereof having an opening therethrough, said housing having a first bore adjacent the other end, said housing having a second bore extending from the inner end of said first bore to the closed end of said housing, a plug positioned in said first bore, said plug having an orifice therethrough and flow restricting means comprised of a spring and ball in said second bore whereby said orifice and said restricting means regulate the flow of water therethrough, the length of said spring combined with the diameter of said ball is less than the length of the second bore so that the ball is spaced from the orifice so as to reduce the turbulence in the water emerging from said orifice, and the diameter of said second bore is substantially constant throughout the length thereof so that the volume of water emerging from said second bore is substantially the same for all positions of said ball within said bore.

2. A device as set forth in claim 1 wherein said second bore has a diameter substantially less than said first bore.

3. A device as set forth in claim 1 wherein the diameter of the orifice is two tenths (0.2) of the outer diameter of the housing.

4. A device as set forth in claim 1 wherein the diameter of said second bore is substantially twice the diameter of said orifice.

5. A device as set forth in claim 1 wherein the outer end of said plug is provided with a conical depression.

* * * * *